US005343570A

United States Patent [19]

Arpaia et al.

[11] Patent Number: 5,343,570

[45] Date of Patent: Sep. 6, 1994

[54] PORTABLE URINAL

[76] Inventors: Josephine J. Arpaia; Paschal J. Arpaia, both of 1500 E. Whitney Rd., Fairport, N.Y. 14450

[21] Appl. No.: 143,659

[22] Filed: Nov. 1, 1993

Related U.S. Application Data

[62] Division of Ser. No. 984,520, Dec. 2, 1992, Pat. No. 5,282,599.

[51] Int. Cl.[5] ..... A61G 9/00; A47K 11/00

[52] U.S. Cl. ..... 4/144.1

[58] Field of Search ..... 4/144.1–144.3; 220/482; 128/761, 767

[56] References Cited

U.S. PATENT DOCUMENTS

| | | | |
|---|---|---|---|
| 3,479,671 | 11/1969 | Beich | 4/144.1 |
| 3,586,276 | 6/1971 | O'Mahoney | 248/215 X |
| 3,716,871 | 2/1973 | Borse | 4/144.2 |
| 3,727,244 | 4/1973 | Collins | 4/144.3 |
| 4,270,231 | 6/1981 | Zint | 4/144.1 |
| 4,696,067 | 9/1987 | Woodward | 4/144.1 |

*Primary Examiner*—Charles E. Phillips

*Attorney, Agent, or Firm*—Robert J. Bird

[57] ABSTRACT

A portable urinal includes a front wall, back wall, and side walls, and a vertical exterior recess in the back wall. A handle connects to the upper portion of the back wall with a gripping finger so the urinal hangs on a horizontal bar with stability. The vertical recess is for stable engagement by a vertical bed rail member. The front wall is narrower than the back wall to facilitate placement of the urinal for use.

2 Claims, 2 Drawing Sheets

PORTABLE URINAL

CROSS-REFERENCE TO RELATED APPLICATION

This is a division of our copending application Ser. No. 07/984,520 filed Dec. 2, 1992, now Pat. No. 5,282,599, the full disclosure of which is incorporated herein by reference.

FIELD OF THE INVENTION

This invention is a portable urinal of the type used in hospitals, nursing homes, and the like.

BACKGROUND INFORMATION

Hospital patients and others who are confined to their beds use hand held portable urinals which are emptied from time to time by an attendant. These urinals must be kept somewhere within reach of the patient.

A hospital room typically includes a number of things in the immediate area of the patient's bed, such as a bedside stand, overbed table, water pitcher, waste basket, electric lines, oxygen equipment, suctioning equipment, personal care articles, flowers, and cards. The portable urinal presently in use is designed to hang from the bedside rail, but it does not hang securely and is known to fall from the rail, forcing the patient or user to set the urinal wherever space can be found, e.g. on the floor, on the bedside table, or even on the overbed table where food is served.

A portable urinal is not a very stable standing vessel. A urinal which is simply set down in the space most conveniently reached, especially in this usually crowded and cumbersome setting, is liable to be stumbled into and knocked over, and its contents spilled. When this happens, everything that comes in contact with the spilled urine is contaminated. There is then the added work and expense of cleaning up an unnecessary spill.

This relatively offhand manner in which portable urinals are generally handled contributes to the spread of nosocomial infections. Nosocomial infection is an infection acquired during hospitalization. Indeed, it is also called "hospital aquired infection".

Sterile materials, dressings, solutions, medications, and the like are often kept on the bedside table. These sterile materials can become contaminated from a urinal placed so nearby, and thus become a source of infection. This is just one example of the problem.

A proper placement for a portable urinal, one which provides upright stability, is out of the way of traffic, and is conveniently within reach of the user and attendants, is therefore to be desired.

SUMMARY OF THE INVENTION

The present invention is a portable urinal with a front wall, back wall, and side walls, and a vertical exterior recess in the back wall. A handle connects to the upper portion of the back wall with a gripping finger so the urinal hangs on a horizontal bar with stability. The vertical recess is for stable engagement by a vertical bed rail member. The front wall is narrower than the back wall to facilitate placement of the urinal for use.

DRAWING

DESCRIPTION

Hospital beds generally include movable bed rails to be raised when appropriate as a safety device to keep the patient from falling out of bed. There are two general types of such bed rails. One is essentially of horizontal bars extending lengthwise along the bed. The other is essentially of vertical bars extending from top to bottom. In either case, the top member is a horizontal bar 40.

Figure 1:
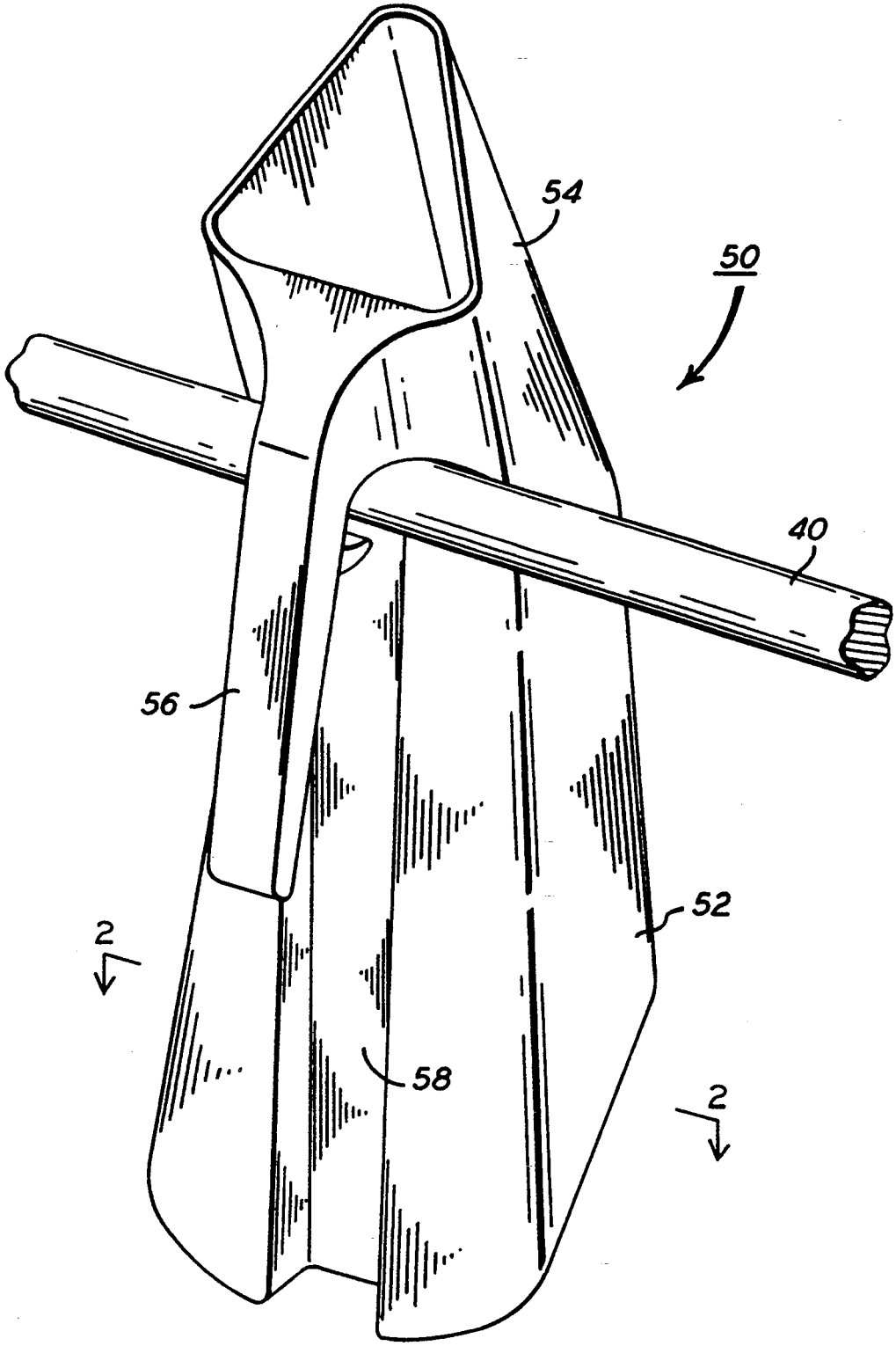
FIG. 1 is a perspective view of a urinal according to this invention.
Figure 2:
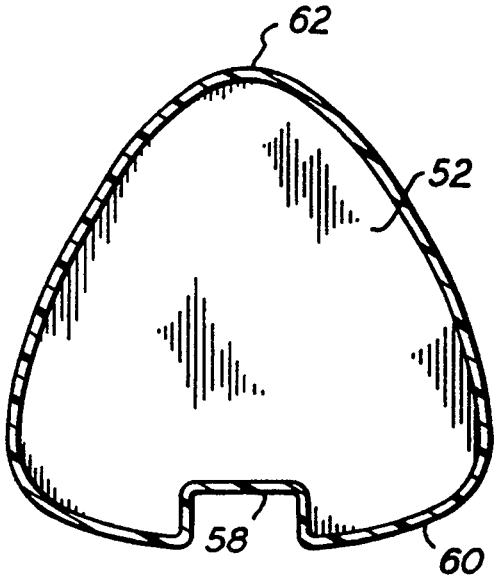
FIG. 2 is a transverse section of the urinal on the plane 2—2 of FIG. 1.

FIGS. 1 and 2 show a urinal according to this invention. The urinal 50 includes a vessel 52 with an upper portion 54 canted related to the lower portion. A handle 56 connects to the upper portion 54 across an extended width of the upper portion 54 and extends down from it, straddling a horizontal bar 40 of a bed rail to thereby hang the urinal 50 on the bar 40. A resilient gripping finger 57, on the inside of the handle 56, grips the bar 40 so that the urinal 50 hangs on the bar with stability. The vessel is of a translucent material, but includes a transparent vertical strip for a sight gage through which the vessel contents are visible and the quantity of which can be recorded if necessary. The vessel also includes a snap-on cover, not shown.

The vessel 52, directly under and behind the handle 56, includes a vertical exteriorly concave recess 58. The urinal 50 hangs on a horizontal bar 40 of a bed rail. If the bed rail also includes vertical bars, the vertical recess 58 engages a vertical bar of the bed rail in a "tongue and groove" manner to prevent swinging of the urinal. The urinal hangs, but does not rock or swing on the bed rail. The urinal 50 is upright and stable, up and out of the way of foot traffic, and conveniently within reach of the user. It contributes to the cleanliness and order of its environment.

Figure 3:
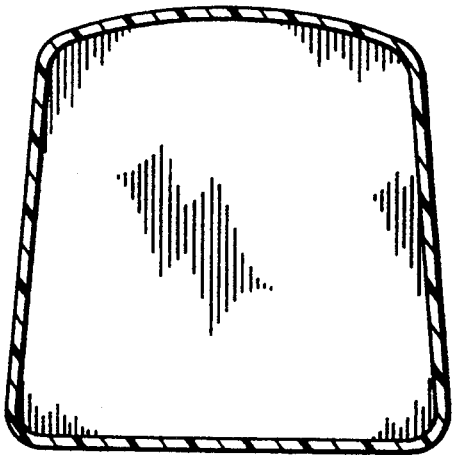
FIG. 3 (PRIOR ART)
FIG. 3 is a similar section of a standard urinal of the prior art.

FIG. 2 shows an additional feature of this urinal. The vessel 52 of the urinal 50 includes back wall 60 and a front or perimeter wall 62 connected to opposite ends of the back wall 60, which walls together with a bottom wall form a liquid confining area. The back wall 60 is on the side of the handle 56 and the recess 58. In use, the urinal is placed with the front 62 down. FIG. 3 shows the general shape of a standard prior art urinal. The shape of our urinal (FIG. 2), with its narrower front wall 62, makes it easier to put in position for use, and is more comfortable than, the standard urinal of the prior art (FIG. 3).

The urinal 50 is of a plastic material. It can be cleansed with bacteriostatic agents and reused.

The foregoing description of a preferred embodiment of this invention, including any dimensions, angles, or proportions, is intended as illustrative. The concept and scope of the invention are limited only by the following claims and equivalent thereof.

We claim:

1. A portable urinal including:

a vessel with a back wall, a perimeter wall connected to opposite sides of said back wall, and a bottom wall;

a handle having a first end depending from an upper portion of said back wall and a second end spaced from said back wall to serve as a means to hang said urinal upon a horizontal bar of a bed rail;

said back wall including a central vertical exteriorly concave recess underlying said handle for engagement by a vertical bar of a bed rail when said handle is hung from a horizontal bar of the bed rail;

said perimeter wall being narrower than said back wall to facilitate placement of said urinal between the legs of a user.

2. A portable urinal as defined in claim 1, said handle including a resilient gripping finger on the inside thereof to grip the horizontal bar.

* * * * *